US007691230B2

(12) United States Patent
Scherb et al.

(10) Patent No.: US 7,691,230 B2
(45) Date of Patent: Apr. 6, 2010

(54) PROCESS AND DEVICE FOR PRODUCING A WEB OF TISSUE

(75) Inventors: Thomas Scherb, Sao Paulo (BR); Luiz Carlos Silva, Campo Limp (BR); Rogerio Berardi, Sao Paulo (BR); Danilo Oyakawa, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 547 days.

(21) Appl. No.: 11/527,236

(22) Filed: Sep. 26, 2006

(65) Prior Publication Data

US 2007/0074837 A1 Apr. 5, 2007

(30) Foreign Application Priority Data

Sep. 30, 2005 (DE) ..... 10 2005 046 907

(51) Int. Cl.
*D21F 11/02* (2006.01)
*D21F 9/02* (2006.01)

(52) U.S. Cl. ..... 162/116; 162/118; 162/122; 162/205; 162/206; 162/283; 162/358.1; 162/358.5; 162/361

(58) Field of Classification Search ..... 162/116, 162/204–207, 363, 364, 367, 375, 358.1, 162/358.3, 358.5; 34/123, 130–132, 618, 34/623, 629, 635; 100/118, 37, 121, 151, 100/153

See application file for complete search history.

(56) References Cited

U.S. PATENT DOCUMENTS

| | | | | | |
|---|---|---|---|---|---|
| 4,300,981 | A * | 11/1981 | Carstens | ..... | 162/109 |
| 4,309,246 | A * | 1/1982 | Hulit et al. | ..... | 162/113 |
| 5,656,134 | A * | 8/1997 | Marinack et al. | ..... | 162/281 |
| 6,187,137 | B1 * | 2/2001 | Druecke et al. | ..... | 162/109 |
| 6,368,458 | B1 * | 4/2002 | Graf et al. | ..... | 162/206 |
| 6,585,858 | B1 * | 7/2003 | Otto et al. | ..... | 162/161 |
| 6,610,173 | B1 * | 8/2003 | Lindsay et al. | ..... | 162/109 |
| 2005/0167061 | A1 * | 8/2005 | Scherb et al. | ..... | 162/115 |
| 2005/0167062 | A1 * | 8/2005 | Herman et al. | ..... | 162/115 |
| 2005/0167066 | A1 * | 8/2005 | Herman et al. | ..... | 162/203 |
| 2005/0167067 | A1 * | 8/2005 | Crook et al. | ..... | 162/348 |

* cited by examiner

*Primary Examiner*—Eric Hug
(74) *Attorney, Agent, or Firm*—Taylor & Aust, P.C.

(57) ABSTRACT

A device for producing a fibrous web and, in particular, a web of tissue including a press zone through which the fibrous web together with an endless permeable structured band and an unstructured permeable supporting band is fed while lying between the structure band and the supporting band, a press nip provided on a drying cylinder through which the fibrous web together with the structured band is fed while lying between the structured band and the drying cylinder, and after which the fibrous web is led from the drying cylinder through a calender.

30 Claims, 1 Drawing Sheet

PROCESS AND DEVICE FOR PRODUCING A WEB OF TISSUE

BACKGROUND OF THE INVENTION

1. Field of the Invention

The invention relates to a device for producing a fibrous web and, in particular, a web of tissue. Furthermore the invention relates to a process for producing a web of tissue. The tissue paper concerned may be, in particular, a hygienic paper such as, for example, toilet paper or facial cloth.

2. Description of the Related Art

Ideally, toilet and facial cloth papers possess a high degree of softness, so-called "structural softness", a high degree of surface softness, so-called "surface softness" in combination with a high tensile strength. This involves the softness being determined essentially by the bulk and the porosity of the tissue paper.

To increase the bulk it has already been proposed that the web of tissue be pressed only zonally during its manufacture in order to obtain only lightly pressed or unpressed bulkier areas of paper in addition to the pressed areas with higher tensile strength properties.

In the course of manufacture of tissue paper the web of tissue is led in a final drying stage around the cylindrical face of a heated Yankee drying cylinder before the finished product is creped by that unit. As this web of tissue passes around the Yankee drying cylinder it is held down by a restraining device under tension.

What is needed in the art is an improved device of the nature already described above. What is needed in the art is a device that produces tissue paper of very high bulk with a high degree of softness. Furthermore, what is needed in the art is tissue paper produced with a softest possible surface without any adverse impact upon the other properties of the tissue paper.

SUMMARY OF THE INVENTION

The present invention includes a device for the manufacture of a fibrous web, in particular a web of tissue, having a press zone through which the fibrous web together with an endless permeable structured band and an unstructured band, i.e. a smooth, permeable support band, is fed while lying between the structured band and the supporting band, and a press nip provided on a drying cylinder through which the fibrous web together with the structured band is fed while lying between the structured band and the drying cylinder, and after which the fibrous web is led from the drying cylinder through a calender.

Essentially, the press nip provided on the drying cylinder transfers the fibrous web from the structured band to the drying cylinder.

During the removal of water from the fibrous web led between the permeable structured band, and the unstructured permeable support band, this takes place in the direction toward the support band.

The calender includes a calender nip formed between two hard rolls through which the fibrous web is led. Neither of the two calender rolls is heated.

As a consequence of this configuration the tissue paper exhibits a very high bulk with a correspondingly high degree of softness. By using an appropriate calender subsequent to the drying cylinder, a soft surface of the tissue paper is obtained while the other properties of the tissue paper are preserved. Furthermore, the tissue paper possesses the desired handle.

Each of the two calender rolls includes a chilled iron roll. Neither of the two rolls is coated.

According to an embodiment of the present invention, the calender consists of only two rolls.

A small open nip or a nip applying only a very low pressure is formed between the two calender rolls. The line load generated in the calender nip is <10 kN/m.

Subsequent to the calender the fibrous web is expediently fed to a reel-up unit which includes expediently a winding core and a pressure application roll which can be positioned or pressed against the reel building up on the winding core.

In order to ensure that the high bulk of the web of tissue already achieved is preserved the line load in the winding gap between the pressure application roll and the reel is preferably ≦0.2 kN/m. In contrast to this the previously customary reel-up units normally exert a line load>0.8 kN/m.

Expediently the winding core of the reel-up unit is driven. Alternatively or additionally, however, the pressure application roll can also be driven.

Since in the situation where the winding core is driven the reel being built up does not have to be turned by the pressure application roll the desired smallest possible line loads in the winding gap can be achieved without any difficulty. In the case of a driven pressure application roll the desired lowest possible line load is also obtainable, however, since in such a case the fibrous web can, for example, be led from the doctor blade to the winding gap by a fabric band with the result that no tension is required here either.

After the fibrous web lying between the structured band and a circulating, endless unstructured band, i.e. a relatively smooth, permeable supporting band, has been pressed in the press zone, a relatively smooth side of the web of tissue can be brought into contact with the drying cylinder, such as a Yankee cylinder, while on the other hand as a result of the structured band lying against the other side of the web only a part of the fibrous or tissue web is subjected to pressure. In contrast to conventional through air drying (TAD) machines approximately 100% of the surface of the relevant side of the web of tissue can be brought into contact with the Yankee cylinder while only a part of that surface is subjected to pressure.

The fibrous web is formed on the structured band in a sheet forming zone. This results in the depressed areas of the structured band being filled with fibers instead of the situation with a conventional TAD procedure where the fibers of a preformed web are sucked into the depressed areas of the structured band.

While the fibrous web is further dewatered from the side remote from the structured band through the supporting and/or dewatering band the fibers are forced in the direction of the relatively flat or smooth surface of the supporting band which is formed, in particular, by a dewatering band. The dewatering process can be brought about, for example, by way of an appropriately high vacuum and/or mechanically, for example, by way of a tensioned band which presses the structured band, the fibrous web, and the supporting band against a smooth surface. The relevant stream of gas passes first through the permeable structured band, then the fibrous web, and finally the preferably permeable supporting band. In contrast, in the case of a conventional TAD procedure the relevant gas stream first passes through the fibrous web and then the structured band. In the case of such a conventional TAD procedure, the fibrous web therefore does not receive a smooth surface. Apart from this, the differential pressure produced in the case of the conventional TAD procedure is relatively small.

The press zone on the side adjacent to the supporting band is bounded by an at least essentially smooth surface.

According to another embodiment of the present invention, the press zone on the smooth surface bounding the side adjacent to the supporting band is formed by a curved surface. This curved surface is formed by a rotating roll.

It is also of particular advantage if a way is provided to produce a gas flow in the region of the press zone, which gas flow passes through the structured band, the fibrous web, and the supporting band. The gas flow passes first through the structured band, then the fibrous web, and finally the supporting band.

In particular, a way to produce an air flow and/or a way to produce a steam flow can be provided.

According to another embodiment of the present invention, the way to produce a gas flow includes a rotating suction roll which is provided with a suction zone and bounds the press zone on the side adjacent to the supporting band. In this case, therefore, the curved, or flat, area is formed by the rotating suction roll.

The gas flow can also be produced at least in part but also wholly by way of a flat or curved suction box or the like which bounds the press zone on the side adjacent to the supporting band.

The gas flow can be produced at least partially by way of an over-pressure hood arranged on the side of the permeable structured band.

Alternatively or additionally, the structured band, the fibrous web, and the supporting band can advantageously be pressed against the smooth surface by way of a press band under tension. Particularly in this situation the smooth surface can be formed again by a rotating roll.

A structured fabric is expediently provided as the structured band.

According to another embodiment of the present invention, a TAD (Through-Air-Drying) fabric is provided as the structured band.

The supporting band can advantageously be a dewatering band, such as a felt.

The relatively depressed and relatively elevated areas of the structured band are so formed and so arranged relative to one another that a maximum of 35% and, preferably, a maximum of 25% of the structured band is pressed in the press nip.

A high degree of gentle pressing is achieved by arranging that the press nip provided on the drying or Yankee cylinder is a shoe press nip.

The fibrous web is transferred in the region of the press nip from the structured band to the surface of the drying or Yankee cylinder. Therefore in this press nip the fibrous web lies between the structured band and the drying cylinder, i.e. on the side of the drying cylinder.

The fibrous web leaving the drying or Yankee cylinder again is then led to the reel-up unit.

The present invention includes the following steps: pressing the web of tissue led between a permeable structured band and an unstructured permeable supporting band; subsequent drying of the web of tissue on a heated surface; and subsequent calendering of the web of tissue.

The present invention can be used to manufacture hygienic paper such as, e.g. toilet paper, cosmetic paper or handkerchief paper.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one embodiment of the invention, and such exemplification is not to be construed as limiting the scope of the invention in any manner.

DETAILED DESCRIPTION OF THE INVENTION

Figure 1:
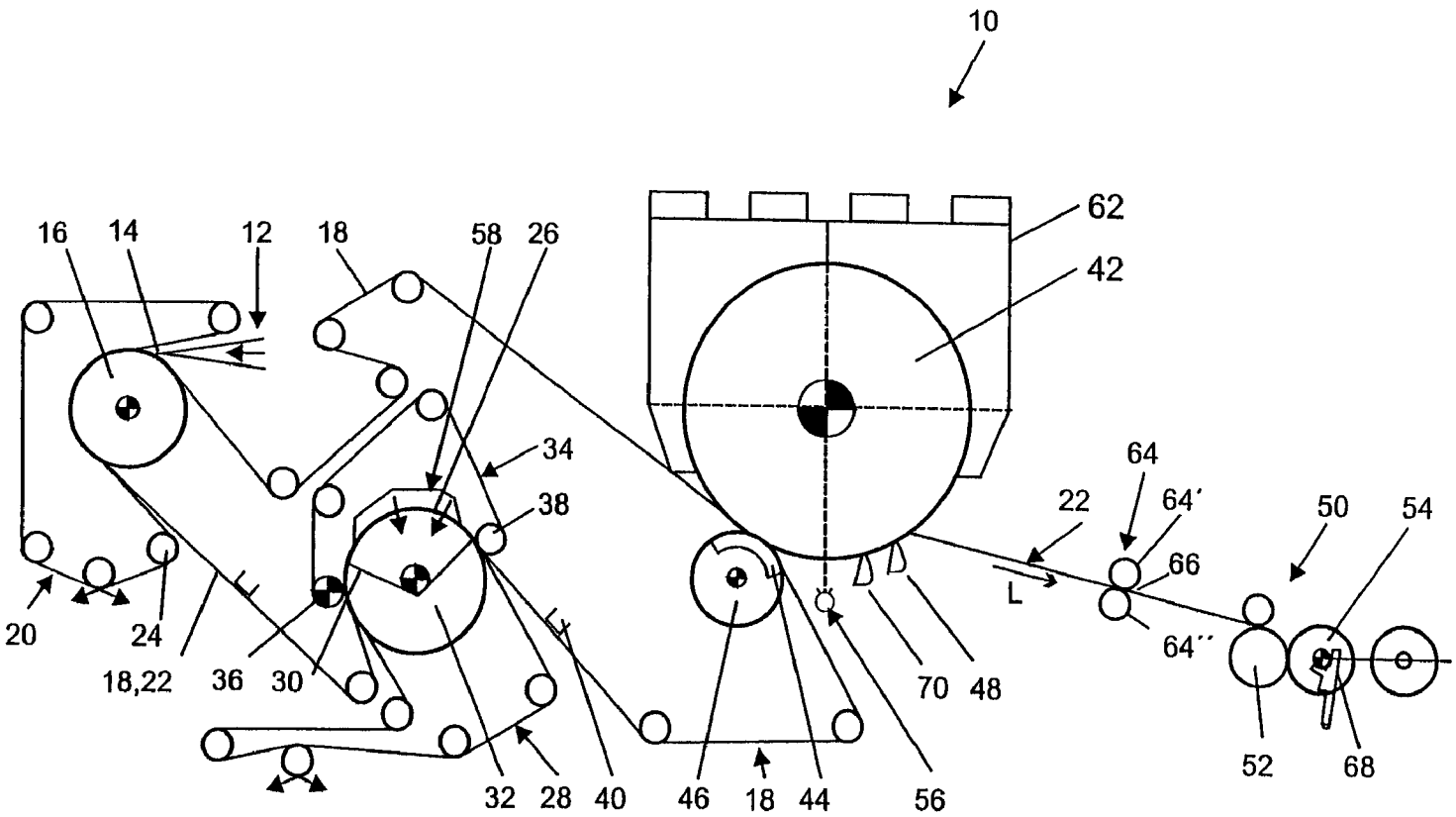
FIG. 1 is a schematic representation of a device for the manufacture of a fibrous web, in particular a web of tissue.

Referring now to the drawing, FIG. 1, there is shown schematic of a device 10 for the manufacture of a fibrous web, which is a web of tissue 22, according to the present invention.

A stock delivery outlet 12 supplies a stream of a suspension of fibrous material into an entry slot 14 which is located in the proximity of a forming roll 16 and between an inner-lying, continuous permeable structured band 18 and an outer-lying, continuous forming fabric 20 which run together in the proximity of the forming roll 16 and then are led together round this forming roll 16.

In particular, the structured band 18 can be a three-dimensionally structured fabric.

Compared with the relevant side of the structured band 18 the forming fabric 20 presents a relatively smooth surface to the web of tissue 22.

Contrastingly, the side of the structured band 18 facing the web of tissue 22 possesses depressed areas and in relation thereto elevated areas, the web of tissue 22 being formed in these depressed and elevated areas of the structured band 18.

For example, the structured band can be formed by a TAD-fabric

The web of tissue 22 is essentially dewatered in the area of the forming roll 16 by the outer-lying forming fabric 20. After this and in the area of a diversion roll 24 the forming fabric 20 is separated again from the web of tissue 22 which together with the structured band 18 is led on to a press zone 26 within which the web of tissue 22 is pressed when lying between the structured band 18 and a continuous unstructured permeable supporting band 28.

In particular, the permeable supporting band 28 can be a felt. In the area of the press zone 26 such pressure is applied to the structured band 18, the web of tissue 22, and the supporting band 28 that the web of tissue 22 is dewatered in the direction of the supporting band 28 consisting of a felt.

Because the web of tissue 22 is dewatered in the press zone 26 in the direction of the permeable supporting band 28 and because in this embodiment the structured band which is led through this press zone is identical with the structured band on which the web of tissue 22 was formed, the more bulky elements of the web of tissue 22 are less strongly compressed than the less bulky elements with the result that the bulky structure of the relevant more bulky elements is retained.

The dewatering pressure for the web of tissue 22 in the press zone 26 is produced at least partially and simultaneously by a gas flow and by mechanical pressure.

The gas flow first passes through the structured band 18, then the web of tissue 22 and finally the permeable supporting band 28.

As can be seen from FIG. 1, the stream of gas is produced by a suction zone 30 in a suction roll 32.

The alternative and additional applied mechanical force is produced by leading the structured band 18, the web of tissue 22 and the supporting band 28 in the press zone 26 between a press band 34 under tension and a smooth surface, which is formed here, for example, by the roll 32.

At least the essential elements of the press zone 26 are defined by the peripheral track of the press band 34 around the cylindrical surface of the suction roll 32 such that this peripheral track is defined by the distance between the two deflection rolls 36, 38.

Subsequent to the suction roll 32 the web of tissue 22 together with the structured band 18 is first led over a suction box 40 and then through a press nip 44 formed on a drying cylinder, namely a Yankee cylinder 42. In this context the web of tissue 22 lies in this press nip 44 between the structured band 18 and the smooth surface of the Yankee cylinder 42. The press nip 44 takes the form of a shoe press nip. A shoe press unit, here a shoe press roll 46, is therefore assigned to the Yankee cylinder 42 to form the press nip 44. As can be seen from FIG. 1, a hood 62 can be assigned to the Yankee cylinder 42.

Since the web of tissue has been formed between the structured band 18 and, with respect to that band, the relatively smooth forming fabric 20, a wave-like surface is exhibited by only the side of the web of tissue 22 formed on the structured band 18. In contrast the surface of the web of tissue 22 generated on the smooth forming fabric 20 is relatively smooth. In the press nip 44 this smooth side of the web of tissue 22 now contacts the smooth surface of the Yankee cylinder 42. The web of tissue 22 therefore comes into contact with the Yankee cylinder over a relatively large area. Since in the present embodiment the structured band 18 led through the press nip 44 is identical with the structured band upon which the web of tissue 22 has been formed, it is ensured that the more bulky areas of the web of tissue 22 are also not pressed for all practical purposes in this press nip 44. On the other hand the less bulky areas of the web of tissue 22 are pressed whereby the strength of the web of tissue 22 is further increased.

Subsequent to the press nip 44 the structured band 18 is separated from the web of tissue 22 when the web of tissue on the Yankee cylinder 42 is led to a doctor 48 where the web of tissue 22 is creped and lifted from the Yankee cylinder 42.

Then the web of tissue 22 is led to a calender 64 and subsequently to a roll-up or reel-up unit 50 in which it is wound into a reel 54 with the assistance of a pressure application roll 52.

The web of tissue 22 is, therefore, transferred from the structured band 18 to the surface of the Yankee cylinder 42 in the area of the press nip 44. The surface of the Yankee cylinder 42 is continuously cleaned here, e.g. by the doctor 48 and then recoated by way of a coating device 56 with the result that a renewed coating always exists in press nip 44. The surface of the Yankee cylinder 42 is cleaned by a further doctor 70.

The calender 64 includes a calender nip 66 formed between two hard rolls 64', 64" through which the fibrous web 22 passes. The two calender rolls 64', 64" are not heated. Each consists of a chilled iron roll and neither is coated.

As can be seen from FIG. 1 the calender 64 consists only of these two hard rolls 64', 64".

The line load generated in the calender nip is <10 kN/m.

Subsequently on leaving the calender 64 the web of tissue 22 is led to the reel-up unit 50 which includes a winding core 68 and a pressure application roll 52, which can be positioned or pressed against the reel 54 being built up on the winding core 68. In order to preserve the previously attained high bulk of the web of tissue 22 the line force in the winding gap between the press roll 52 and the reel 54 is selected to be ≦0.2 kN/m.

As can be seen from FIG. 1 in an embodiment of the present invention, the winding core 68 is driven.

In particular, an air flow and/or a steam flow can be produced as the gas flow which in the press zone 22 first passes through the structured band 18, then the web of tissue 22, and finally the supporting band 28.

As an alternative or an addition to the suction roll 32 the gas flow can also be produced at least partially by way of an over-pressure hood or steam-blowing box 58 arranged on the side of the permeable structured band 18.

A three-dimensionally structured fabric, for example, a TAD fabric, can be used as the structured band 18.

In particular, a dewatering band can be provided as the supporting band 28.

The relatively depressed and the relatively elevated areas of the structured band 18 are so formed and arranged relative to one another that a maximum of 35% and preferably a maximum of 25% of the structured band 18 is pressed within the press nip 44 formed with the Yankee cylinder 42.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE NUMBER LIST

10 Device
12 Stock delivery outlet
14 Entry slot
16 Forming roll
18 Structured band
20 Forming fabric
22 Web of tissue
24 Deflection roll
26 Press zone
28 Supporting band
30 Suction zone
32 Suction roll
34 Press band
36 Deflection roll
38 Deflection roll
40 Suction box
42 Yankee cylinder
44 Press nip
46 Shoe press roll
48 Doctor
50 Reel-up unit
52 Pressure application roll
54 Reel
56 Coating device
58 Over-pressure hood, steam blow box
62 Hood
64 Calender
64' Calender roll, hard roll
64" Calender roll, hard roll
66 Calender nip
68 Winding core
70 Doctor

What is claimed is:

1. A device for producing a fibrous web comprising:

an endless permeable structured band;

an unstructured permeable supporting band;

a press zone through which the fibrous web, said endless permeable structured band, and said unstructured permeable supporting band together are fed while the fibrous web lies between said structured band and said supporting band;

a drying cylinder defining a press nip through which the fibrous web together with said structured band are fed while the fibrous web lies between said structured band and said drying cylinder;

a calender through which said fibrous web is led after the fibrous web departs from said drying cylinder, said calender including two hard calender rolls forming a calender nip through which the fibrous web is led, said calender nip generating a line load<10 kN/m; and a reel-up unit including a winding core and a pressure application roll, the fibrous web being led to said reel-up unit subsequent to said calender, said pressure application roll being positioned against a reel building up on said winding core, a winding gap formed between said pressure application roll and said reel, a line load applied in said winding gap being ≦0.2 kN/m.

2. The device of claim 1, wherein said two hard calender rolls are unheated.

3. The device of claim 1, wherein each of said two hard calender rolls comprises a chilled iron roll.

4. The device of claim 1, wherein said two hard calender rolls are uncoated.

5. The device of claim 1, wherein said calender comprises only said two hard calender rolls.

6. The device of claim 1, further comprising a fabric band, wherein the fibrous web is led to said reel-up unit by said fabric band.

7. The device of claim 1, wherein said winding core is driven.

8. The device of claim 1, wherein said pressure application roll is driven.

9. The device of claim 1, wherein the fibrous web is formed on said structured band in a sheet forming zone.

10. The device of claim 1, wherein said drying cylinder is a Yankee cylinder.

11. The device of claim 1, wherein said press zone includes a side adjacent to said supporting band and includes an at least essentially smooth surface, said press zone bounded on said side by said at least essentially smooth surface.

12. The device of claim 11, wherein said at least essentially smooth surface comprises a curved surface.

13. The device of claim 12, further comprising a rotating roll, said rotating roll comprising said curved surface.

14. The device of claim 12, further comprising a press band, wherein said structured band, said fibrous web, and said supporting band are pressed against said at least essentially smooth surface by said press band under tension.

15. The device of claim 14, further comprising a rotating roll, said rotating roll comprising said at least essentially smooth surface.

16. The device of claim 1, including a gas flow generator in said press zone for producing a gas flow through said structured band, said fibrous web, and said supporting band.

17. The device of 16, wherein said gas flow passes first through said structured band, then through the fibrous web, and finally through said supporting band.

18. The device of claim 16, wherein said gas flow generator comprises at least one of an air flow generator and a steam flow generator.

19. The device of claim 16, wherein said press zone includes a side adjacent to said supporting band, said gas flow generator comprises a rotating suction roll, said rotating suction roll having a suction zone and bounding said press zone on said side.

20. The device of claim 16, wherein said press zone includes a side adjacent to said supporting band, said gas flow generator comprises one of a flat suction box and a curved suction box, said one of a flat suction box and a curved suction box bounding said press zone on said side.

21. The device of claim 16, wherein said permeable structured band has a side, said gas flow generator comprises an over-pressure hood arranged on said side.

22. The device of claim 1, wherein said structured band is a structured fabric.

23. The device of claim 1, wherein said structured band is a through-air-drying fabric.

24. The device of claim 1, wherein said supporting band is a dewatering band.

25. The device of claim 24, wherein said dewatering band is a felt.

26. The device of claim 1, wherein said structured band includes a plurality of relatively depressed areas and a plurality of relatively elevated areas, said plurality of relatively depressed areas and said plurality of relatively elevated areas of said structured band are so formed and so arranged relative to one another that a maximum of 35% of said structured band is pressed in said press nip.

27. The device of claim 1, wherein said structured band includes a plurality of relatively depressed areas and a plurality of relatively elevated areas, said plurality of relatively depressed areas and said plurality of relatively elevated areas of said structured band are so formed and so arranged relative to one another that a maximum of 25% of said structured band is pressed in said press nip.

28. The device of claim 1, wherein said press nip is a shoe press nip.

29. The device of claim 1, wherein the device includes a region of said press nip, said drying cylinder having a surface, said fibrous web being transferred in said region of said press nip from said structured band to said surface of said drying cylinder.

30. A process for producing a web of hygienic tissue comprising the sequential steps of:

pressing the web of tissue led between a permeable structured band and an unstructured permeable supporting band;

drying the web of tissue on a heated surface;

calendering the web of tissue using a calender including two hard calender rolls forming a calender nip through which the fibrous web is led, said calender nip generating a line load<10 kN/m; and leading the fibrous web to a reel-up unit subsequent to said calender, said reel-up unit including a winding core and a pressure application roll, said pressure application roll being positioned against a reel building up on said winding core, a winding gap formed between said pressure application roll and said reel, a line load applied in said winding gap being ≦0.2 kN/m.

* * * * *